United States Patent [19]

Kardos et al.

[11] 4,036,711

[45] July 19, 1977

[54] ELECTRODEPOSITION OF COPPER

[75] Inventors: Otto Kardos, Ferndale; Donald A. Arcilesi, Mount Clemens; Silvester P. Valayil, Pontiac, all of Mich.

[73] Assignee: M & T Chemicals Inc., Greenwich, Conn.

[21] Appl. No.: 724,692

[22] Filed: Sept. 17, 1976

Related U.S. Application Data

[63] Continuation-in-part of Ser. No. 641,965, Dec. 18, 1975, abandoned, which is a continuation of Ser. No. 525,716, Nov. 21, 1974, abandoned, which is a continuation-in-part of Ser. No. 315,112, Dec. 14, 1972, abandoned.

[51] Int. Cl.[2] ..... C25D 3/38

[52] U.S. Cl. ..... 204/52 R

[58] Field of Search ..... 204/52 R, 44; 106/1

[56] References Cited

U.S. PATENT DOCUMENTS

| | | | |
|---|---|---|---|
| 2,849,351 | 8/1958 | Gundel et al. | 204/44 |
| 2,849,352 | 8/1958 | Kirstahler et al. | 204/44 |
| 3,000,800 | 9/1961 | Strauss et al. | 204/52 R |
| 3,023,150 | 2/1962 | Willmund et al. | 204/44 |
| 3,081,240 | 3/1963 | Strauss et al. | 204/52 R |
| 3,267,010 | 8/1966 | Creutz et al. | 204/52 R |
| 3,328,273 | 6/1967 | Creutz et al. | 204/52 R |
| 3,542,655 | 11/1970 | Kardos et al. | 204/52 R |
| 3,650,915 | 3/1972 | Quimby et al. | 204/52 R |
| 3,682,788 | 8/1972 | Kardos et al. | 204/52 R |
| 3,732,151 | 5/1973 | Abbott | 204/52 R |

*Primary Examiner*—G. L. Kaplan

*Attorney, Agent, or Firm*—Kenneth G. Wheeless; Robert P. Auber; Robert Spector

[57] ABSTRACT

This invention relates to novel compositions and to a process for electrodepositing copper from an aqueous acidic copper plating bath containing at least one member independently selected from each of the following two groups:

A. 0.005 gram per liter to 10.0 grams per liter of quaternized aryl and aralkyl amines selected from those exhibiting the formulae:

I.

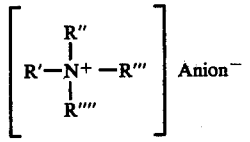

II.

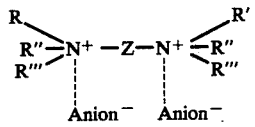

III.

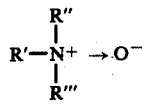

IV.

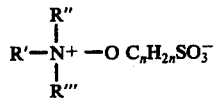

wherein R′, R″, R‴ and R⁗ are each independently selected from the group consisting of substituted and unsubstituted monovalent alkyl, aryl, aralkyl and cycloalkyl radicals provided that at least one aryl or aralkyl radical is present on each quaternary nitrogen atom; wherein Z is a bivalent hydrocarbon radical which may be substituted and/or interrupted by heteroatoms; wherein $n=3$ or 4; and wherein the Anion may be absent if one of the radicals R′ to R⁗ carries an anionic substituent.

B. sulfoalkyl sulfide compounds containing the grouping —S—Alk—$SO_3M$ where M is one gram-equivalent of a cation and — Alk — is a divalent radical selected from a group consisting of unsubstituted and substituted aliphatic hydrocabon radicals containing 2 to 8 carbon atoms which may be interrupted by heteroatoms in an amount of 0.01 milligrams per liter to 1000 milligrams per liter.

22 Claims, No Drawings

ELECTRODEPOSITION OF COPPER

This application is a continuation in part of U.S. patent application Ser. No 641,965 filed Dec. 18, 1975 which in turn was continuation of U.S. patent application Ser. No. 525,716 filed Nov. 21, 1974 which was a continuation in part of U.S. patent application Ser. No. 315,112 filed Dec. 14, 1972, all now abandoned.

This invention relates to novel compositions and to a process for electrodepositing copper from an aqueous acidic copper plating bath containing at least one member from each of the following two groups:

A. 0.005 gram per liter to 10.0 grams per liter of quaternized aryl and aralkyl amines selected from those exhibiting the formulae:

I.

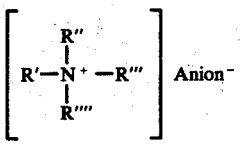

II.

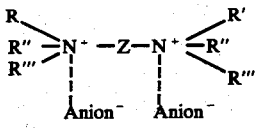

III.

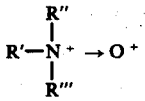

IV.

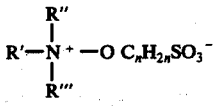

wherein R′, R″, R‴, and R⁗ are each independently selected from the group consisting of alkyl, aryl, aralkyl, alkaryl and cycloalkyl provided that at least one aryl group is present;

B. sulfoalkyl sulfide compounds containing the grouping —S—Alk—$SO_3M$ where M is one gram-equivalent of a cation and — Alk — is a divalent radical selected from a group consisting of unsubstituted and substituted aliphatic hydrocarbon radicals containing 2 to 8 carbon atoms which may be interrupted by heteroatoms in an amount of 0.01 milligrams per liter to 1000 milligrams per liter.

DETAILED DESCRIPTION

Practice of this invention results in copper deposits which, depending on bath composition and operating conditions, are very suitable for rotogravure applications, or for the plating of printed circuit boards, or for electroforming, or are fully bright and strongly leveling for decorative purposes. These advantages are realized by addition of at least one member of each of the following two groups:

A. 0.005 gram per liter to 10.0 grams per liter of quaternized aryl and aralkyl amines selected from those exhibiting the formulae:

I.

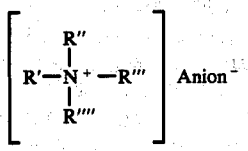

II.

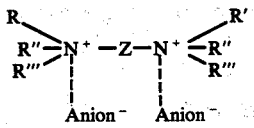

III.

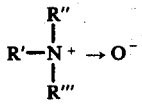

IV.

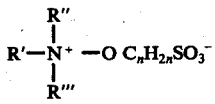

wherein R′, R″, R‴, and R⁗ are each independently selected from the group consisting of substituted and unsubstituted monovalent alkyl, aryl, aralkyl and cycloalkyl radicals provided that at least one aryl or aralkyl radical is present on each quaternary nitrogen atom; wherein Z is a bivalent hydrocarbon radical which may be substituted and/or interrupted by heteroatoms; wherein $n=3$ or 4; and wherein the anion may be absent if one of the radicals R′ to R⁗ carries an anionic substituent.

B. sulfoalkyl sulfide compounds containing the group —S—Alk—$SO_3M$ where M is one gram-equivalent of a cation and — Alk —is a divalent radical selected from a group consisting of unsubstituted and substituted aliphatic hydrocarbon radicals containing 2 to 8 carbon atoms which may be interrupted by heteroatoms in an amount of 0.01 milligrams per liter to 1000 milligrams per liter.

To obtain strongly leveling copper deposits, and often also to obtain fully bright copper deposits over a wide current density range, further addition of at least one member of the group of leveling agents that is diffusion controlled inhibitors, (Group (C) is required.

Simultaneous presence of at least one member of each group (A) and (B) in the acid copper bath produces superior copper electrodeposits to those obtained when only members of one group are present in respect to one or more of the following properties: greater smoothness, greater brightness, greater hardness, or greater softness and ductility, and/or better response to the addition of a leveling agent.

Structure II (N-oxide) may be derived from I by replacement of one radical and of the anion by an oxygen atom, bound to the nitrogen by a polar coordinate linkage.

Structure III (reaction product of an N-oxide with propane or butane sultone) may be derived from I by replacement of one radical by the —$O(CH_2)_nSO_3^-$ or —$O(C_nH_{2n})SO_3^-$ group.

The amines of this invention may be present in the copper bath of this invention is effective amounts of 0.01 grams per liter to 10 grams per liter of total aqueous bath composition.

Typical amines which may be employed according to this invention include the following compounds which are summarized in Table I.

Anion$^-$ may be $OH^-$, $SO_4=/2$, $HSO_4^-$, $BF_4^-$, $CH_3SO_3^-$, $C_6H_5SO_3^-$, $CH_3C_6H_4SO_3^-$, $H_2PO_4$, $HPO_4=/2$, $PO_4^{\equiv}/3$, etc. It may also be Cl , but an acid copper bath tolerates Cl only up to about 150 mg/l and preferably 60 or 80 mg/l. Thus the Anion of Formulae I and II may be Cl if these Amines are rather effective and consequently used only in relatively small concentrations. The concentrations of Br and especially I tolerated without harm to the quality of the copper deposit are considerably smaller.

TABLE I

COOPERATING AMINES

1. $[C_6H_5CH_2N^+(CH_3)_2(CH_2)_2OH]\,OH^-$
2. $[C_6H_5CH_2N^+(CH_2CHOHCH_3)_3]\,Cl^-$
3. $[C_6H_5CH_2N^+(CH_3)_3]\,OH^-$
4. $C_6H_5N^+(CH_2CHOHCH_3)_2(CH_2)_3SO_3^-$
5. $[(C_6H_5CH_2)_2N^+(CH_3)_2]\,Cl^-$
6. $(C_6H_5CH_2)_2N^+(CH_2CH_2O)_3H(CH_2)_3SO_3^-$
7. $(C_6H_5CH_2)_2N^+CH_2CH_2OH(CH_2)_3SO_3^-$
8. $C_6H_5CH_2N^+(C_2H_5)(C_6H_5)(CH_2)_3SO_3^-$
9. $[(CH_3)_2C_6H_5CH_2N^+CH_2CHOHCH_2N^+(CH_3)_2CH_2C_6H_5]\,2Cl^-$
10. $C_6H_5CH_2N^+(CH_3)_2O(CH_2)_3SO_3^-$
11. $C_6H_5CH_2N^+(CH_3)_2O^-$
12. $[(CH_3)_2C_6H_5CH_2N^+CH_2C_6H_4CH_2N^+(CH_3)_2CH_2C_6H_5]\,2Cl^-$

The cooperating sulfoalkylsulfides exhibit the formula:

$$RS - Alk - SO_3M$$

where M denotes one gram-equivalent of a cation and — Alk — is a divalent aliphatic group of 1–8 carbon atoms; — Alk — may be a saturated or unsaturated divalent aliphatic hydrocarbon group, which may or may not carry inert substituents such as hydroxyl, alkyl, hydroxyalkyl, and alkoxy in which the carbon chain may be interrupted by heteroatoms. Typical examples of — Alk — are:

$-(CH_2)_m-$ where m is 1 to 8, $-CH_2CHOHCH_2-$, $-CH_2CH(CH_2OH)-$,

-continued $-CH_2CH_2CH(CH_3)-$, $-CH_2C(CH_3)_2CH_2CH(CH_3)-$, $-CH_2CH{=}CHCH_2-$, $-CH_2C{\equiv}CCH_2-$, $-CH_2CH_2OCH_2CH_2-$.

In the compound R—S—Alk—$SO_3M$ R may be a hydrogen radical preferably selected from the group consisting of alkyl, alkenyl, alkynyl, cycloalkyl, aryl, aralkyl, alkaryl, including such radicals when inertly substituted such as preferably sulfoalkyl. R may be a sulfide or polysulfide containing up to four bivalent sulfur atoms of these hydrocarbon radicals, such as Alk $S_n$— and $MO_3S$—Alk—$S_n$—, where $n$ = 1 to 4; or it may be a sulfoalkylthioalkyl group such as $MO_3S$—Alk—S—Alk—.

R may be hydrogen or a metal cation or their sulfides and polysulfides $MS_n$—. It may be a sulfonic group $MO_3S$— (e.g. in the reaction product of sodium thiosulfate and 1,3-propanesultone, $MO_3S\,Alk\,S\,C(=S)-$, $(Alkyl)_2N\,C(=S)-$, $Alkyl\,O\,C(=S)-$, an aminoiminomethyl (formamidine) group $(HN{=})(H_2N)C-$, a 1,1-dioxytetrahydrothienyl (sulfolanyl) group or a heterocyclic ring which may be substituted by other sulfoalkylsulfide groups, etc.

The sulfoalkylsulfides may be employed in effective amounts of 0.01 mg/l to 1000 mg/l of total aqueous bath composition. Typical sulfoalkylsulfides which may be employed according to this invention include the following compounds which are summarized in Table II.

TABLE II

COOPERATING SULFOALKYL SULFIDES (SAS) OF THE FORMULA RS —ALK —$SO_3$ M

| SAS NO. | R | Alk | M |
|---|---|---|---|
| 1 | $NaO_3S(CH_2)_3S$ | $-(CH_2)_3-$ | Na |
| 2 | $NAO_3S(CH_2)_3SS$ | $-(CH_2)_3-$ | Na |
| 3 | $NaO_3S(CH_2)_4S$ | $-(CH_2)_4-$ | Na |
| 4 | $C_6H_5S$ | $-(CH_2)_3-$ | Na |
| 5 | $NH(CH_2)_3SO_3H$ / S | $-(CH_2)_3$ | Na |
| 6 | H | $-(CH_2)_2-$ | Na |
| 7 | H | $-(CH_2)_3-$ | Na |
| 8 | $NaO_3S$ | $-(CH_2)_3-$ | Na |
| 9 | $NaO_3S(CH_2)_3SC(=S)$ | $-(CH_2)_3-$ | Na |
| 10 | $(C_2H_5)_2NC(=S)$ | $-(CH_2)_3-$ | Na |
| 11 | $C_2H_5OC(=S)$ | $-(CH_2)_3-$ | K |

TABLE II-continued

| COOPERATING SULFOALKYL SULFIDES (SAS) OF THE FORMULA RS —ALK —$SO_3$M | | | |
|---|---|---|---|
| SAS NO. | R | Alk | M |
| 12 | $NaO_3S(CH_2)_3$ | $-(CH_2)_3-$ | Na |
| 13 | $NaO_3S(CH_2)_3S(CH_2)_3$ | $-(CH_2)_3-$ | Na |
| 14 | $NaO_3S(CH_2)_3S(CH_2)_6$ | $-(CH_2)_3-$ | Na |
| 15 | $C_6H_5$ | $-(CH_2)_3-$ | Na |
| 16 | $C_6H_5CH_2$ | $-(CH_2)_3-$ | Na |
| 17 | 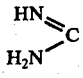 | $-(CH_2)_3-$ | Na |
| 18 | $NaO_3SCH_2CHOHCH_2S$ | $-CH_2CHOHCH_2-$ | Na |
| 19 | 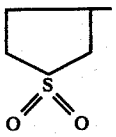 | $-(CH_2)_3-$ | Na |
| 20 | 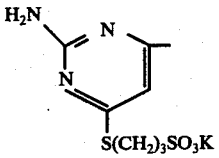 | $-(CH_2)_3$ | K |
| 21 | 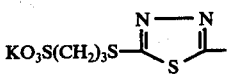 | $-(CH_2)_3-$ | K |

Another aspect of this invention is the one of obtaining strongly leveled copper deposits, that is copper deposits which are substantially smoother than the substrate on which they are deposited. In order to possess leveling properties the acid copper plating bath must contain besides at least one member of each of the groups (A) and (B) also at least one member of group (C) comprising the leveling agents, i.e. diffusion controlled inhibitors.

Besides producing leveling the leveling agent frequently also increases brightness, and widens the bright current density range. It may also prevent roughness formation at high current density and increase hardness.

An acid copper bath containing at least one additive from each of the two groups (A) and (B) responds much better to the addition of a leveling agent than a copper bath containing only members of one of the two groups or no members of these two groups.

Leveling agents which cooperate very well with addition agents of groups (A) and (B) are those containing a $-\underset{\underset{SH}{|}}{C}=N-$ group or its tautomeric form $-\underset{\underset{S}{\|}}{C}-NH-$.

These tautomeric groups may be a part of a noncyclic molecule, such as an open thiourea in which they become a part of the wider groups $>N-\underset{\underset{SH}{|}}{C}=N-$ or $>N-\underset{\underset{S}{\|}}{C}-NH-$ or they may be a part of heterocyclic rings where they may become a part of the wider groups $>N-\underset{\underset{S}{\|}}{C}-NH-$, $-S-\underset{\underset{S}{\|}}{C}-NH$, -continued $-O-\underset{\underset{S}{\|}}{C}-NH-$, $=\overset{|}{C}-\underset{\underset{S}{\|}}{C}-NH-$, $=\overset{|}{C}-\underset{\underset{S}{\|}}{C}-\underset{\underset{OH}{|}}{N}-$ and/or their corresponding tautomeric forms.

Typical leveling agents of the open thiourea type operable in the practice of this invention are set forth in Table III of U.S. Pat. No. 3,682,788 which issued Aug. 8, 1972, upon the application of O. Kardos et al., e.g., thiourea, N-ethylthiourea(1-ethylthiourea), N,N'-diethylthiourea (1,3-diethylthioura), N-phenylthiourea(1-phenylthiourea), etc.

Typical leveling agents of the heterocyclic type are set forth in Table III of U.S. Pat. No. 3,542,655 which issued Nov. 24, 1970, upon the application of O. Kardos et al., e.g., 2-thiazolidinethone (2-mercaptothiazoline), 2-imidazolidinethione(ethylenethiourea) and its N-hydroxyethyl derivative, 2-pyrimidinethiol(2-mercaptopyrimidine) and in Table III of U.S. Pat. No. 3,804,729 which issued Apr. 16. 1974, e.g. 2-mercaptopyridine, 2-mercaptoquinoline, their N-oxides, and other derivatives in which the —SH group is replaced by $-SC\begin{matrix}NH\\ \|\\ NH_2\end{matrix}$, $-\underset{\underset{S}{\|}}{SC}NH_2$ and similar groups. Also levelers which instead of the group $-\underset{\underset{SH}{|}}{C}=N-$ contain the corresponding mercury compound $-\underset{\underset{S-Hg-Cl}{|}}{C}=N-$ cooperate very well with the Amine plus Sulfoalkylsulfide combination.

A different type of cooperating leveling and brightening agent comprises relatively high-molecular cations such as basic phenazine azo dyestuffs like Janus Green B (diethylphenosafranine azo dimethylaniline, color Index No. 11050) or Janus Black (diethylphenosafranine azo phenol, C. I. Basic Black 2, Color Index No. 11825), and certain cationic polymers such as the polyalkyleneimines and the polymers and copolymers of 2-vinylpyridine and/or 2-methyl-5-vinylpyridine and their quaternization products with alkyl halides, benzyl halides, or 1,3-propanesultone. Simultaneous use of at least one member of each of these two types of leveling agents, together with at least one member of each group (A) and (B), often results in beneficial effects as compared with those obtained with levelers of only one type, in respect to the degree and the current density range of brightness and leveling.

Another type of compounds which often exerts beneficial effects on the copper electrodeposit when used in conjunction with at least one compound of each of the two groups (A) and (B), or of each of the three groups (A), (B) and (C) are the condensation products of an aldehyde, especially formaldehyde, with napththalene sulfonic acids, such as methylene bis-(2-naphthalene sulfonic acid) or higher molecular condensation products of this type in which, for instance, three, or, more generally, n, napthalene sulfonic acid groups are linked by two, or, more generally, $n-1$, methylene groups. Addition of such compounds, e.g. of 0.01 to 5 g/l of the sodium salt of methylene bis-(2-naphthalene sulfonic acid) often increases the brightness and high current density smoothness of copper deposits as compared with deposits obtained from copper baths containing only members of groups (A) and (B), or only members of groups (A), (B) and (C), as shown in Example 1.

Still another type of compounds which often exerts beneficial effects when used in conjunction with compounds of the two groups (A) and (B), or with compounds of the three groups (As), (B) and (C) are the polyethers, especially those of rather high molecular weight. As dilute concentrations as 0.001 g/l to 0.005 g/l of a polyethyleneglycol of a molecular weight of 1000 or 6000 or 20,000, or of a nonylphenol condensate with 100 moles ethylene oxide, or of a block polymer of 80% ethylene oxide andd 20% propylene oxide and approximate molecular weight 5000, considerably increase leveling, especially in the low current density area, and often also increases brightness and bright current density range (See examples 2, 3, 5 and 8).

The polyether additives may be employed in amounts of 0.001 to 10 grams per liter.

The novel compositions of the invention may be employed in combination with aqueous acidic copper plating baths. Typical aqueous acidic copper plating baths which may be employed in combination with the novel additive compositions of this invention include the following:

| | | |
|---|---|---|
| | SULFATE BATH | |
| (1) | $CuSO_4 \cdot 5H_2O$ | 30–300 g/l |
| | $H_2SO_4$ | 10–250 g/l |
| | $Cl^-$ | 0–150 mg/l |
| | FLUOBORATE BATH | |
| (2) | $Cu(BF_4)_2$ | 50–600 g/l |
| | $HBF_4$ | 1–300 g/l |
| | $H_3BO_3$ | 0–30 g/l |
| | $Cl^-$ | 0–150 mg/l |

For the deposition of bright, leveling copper about 220 g/l of $CuSO_4.5H_2O$ or $CU(BF_4)_2$, about 60 g/l of $H_2SO_4$ or 3.5 g/l of $HBF_4$, and about 20 to 80 mg/l of chloride ion are preferred. For high-speed plating, e.g., the plating of printing rolls, higher concentrations of the free acids and/or of the copper fluoborate are often preferred. For the plating of printed circuit boards, which requires high throwing power, low metal and high acid concentrations are most suitable.

The plating conditions for electrodeposition from the aforementioned baths may, for example, include temperatures of 10° C.–60° C. (preferably 20° C.–40° C.); pH (electrometric) of less than about 2.5; and a cathode current density of 0.1–50.0 amperes per square decimeter (asd).

The substrates which may be electroplated in accordance with the process of this invention may include ferrous metals, such as steel, iron, etc., bearing a surface layer of nickel or cyanide copper; zinc and its alloys including zinc-base die-cast articles bearing a surface layer of cyanide copper or pyrophosphate copper; nickel, nickel alloys with other metals such as cobalt or iron; aluminum, including its alloys, after suitable pretreatment; and non-conducting materials, e.g., plastics, after suitable pretreatment, etc.

The following examples are set forth for the purpose of providing those skilled-in-the-art with a better understanding of this invention, and the invention is not to be construed as limited to such examples.

The plating experiments reported in the following examples were performed — unless otherwise state — in a Hull Cell containing 250 ml of acid copper sulfate bath. The Hull Cell allows one to observe the appearance of the deposit over a wide current density range. In order to judge the degree of leveling the polished brass panels used for these plating tests were scratched with 4/0 emery polishing paper over a horizontal band of about 10 mm. width. The plating temperature used in these experiments was the ambient room temperature (24°–30° C.) unless otherwise stated. The total current was 2 amperes and the plating time 10 minutes. Air agitation was used in all cases. The amines used are listed in Table I, the sulfoalkylsulfides in Table II.

Two types of acid sulfate copper baths were used in these experiments:

| | | |
|---|---|---|
| Type 1.) | Regular Sulfate Copper containing | |
| | $CuSO_4 \cdot 5H_2O$ | 220 g/l |
| | $H_2SO_4$ | 60 g/l |
| | Chloride ion | 0.06 g/l |
| and Type 2.) | High-Throw Sulfate Copper containing | |
| | $CuSO_4 \cdot 5H_2O$ | 100 g/l |
| | $H_2SO_4$ | 200 g/l |
| | Chloride ion | 0.06 g/l |

The chloride concentrations indicated above are those after addition of the various additives as some amines of Table I contain chloride.

The hardness values given in Example 1 refer to microhardness obtained with a diamond pyramid indenter under a load of 50 grams ($DPH_{50}$) on copper deposits about 0.025 mm. thick.

EXAMPLE I

In the regular copper bath (Type 1) 2 grams per liter of Amine No. 1 gave a dark matte Hull Cell deposit with high current density striations. Further addition of 0.015 grams per liter of Sulfoalkylsulfide No. 1 produced a smooth deposit which was bright from about 2.5 amp./sq.dm. upwards. Final addition of 0.0015 grams per liter of N,N'-diethylthiourea gave a bright leveling copper deposit.

In the High-Throw copper bath (Type 2) 0.4 grams per liter of Amine No. 1 gave a dark matte copper deposit in the Hull Cell. Further addition of 0.6 grams per liter of the sodium salt of methylene bis-(2-naphthalene sulfonic acid) produced a uniform satin copper deposit, and final addition of 0.0015 grams per liter of Sulfoalkylsulfide No. 1 produced a uniform semi-bright copper deposit which was ductile and rather soft ($DPH_{50} = 104$) with excellent coverage of the backside of the Hull Cell panel. This combination should be very suitable for the through-hole plating of printed circuit boards.

EXAMPLE II 0.5 g/l of Amine No. 2 gave in a copper bath of Type 1, a matter copper deposit above about 0.5 amp./sq.dm., a semibright deposit below this current density. Further addition of 0.015 g/l of Sulfoalkylsulfide No. 1 produced a bright deposit above about 4 amp./sq.dm. Addition of 0.0015 g/l of 2-mercaptothiazoline as the third additive slightly improved brightness and bright current density range and produced some leveling. Final addition of 0.0025 g/l of Pluronic 10R8 (Wyandotte Chemicals Corporation), a block polymer having a polyoxyethylene group of approximate molecular weight 4000 in the center and two polyoxypropylene groups, each of approximate molecular weight 500, on either end, gives a very bright and strongly leveling copper deposit above about 0.5 amp./sq.dm. This quadruple combination of additives gives a copper deposit far superior to those attained with only three additives present e.g. in absence of Amine No. 2.

Also the combined use of 0.5 g/l of Amine No. 2, 0.015 g/l Sulfoalkylsulfide No. 1, 0.005 g/l Janus Green and 0.0025 g/l Pluronic 10R8 gives a bright and strongly leveling copper deposit above 0.5 amp./sq.dm.

EXAMPLE III

In a copper bath of Type 1, addition of 0.1 g/l of Amine No. 5 gives a strongly striated copper deposit except below about 0.4 amp./sq.dm. where it is bright. Addition of 0.015 g/l of Sulfoalkylsulfide No. 1 produces a bright deposit from about 1.8 amp./sq.dm. to at least 12 amp./sq.dm. Final addition of either 0.0015 g/l of 2-mercaptothiazoline or 0.010 g/l of Janus Green strongly increases leveling and widens the bright current density range down to about 0.15 amp./sq.dm. Simultaneous addition of these two levelers further improves leveling and extends brightness over the whole Hull Cell panel.

If, instead of one or both of these levelers, 0.005 g/l of a poly-2-vinylpyridine of approximate molecular weight 40 to 60,000 quaternized with an alkylchloride or 0.005 g/l of a polyethoxylated polyethylene imine (approximate molecular weight 60,000) is added to an acid copper bath of Type 1 containing 0.1 g/l of Amine No. 5 and 0.015 g/l of Sulfoalkylsulfide No. 1 a strongly leveling bright copper deposit is obtained over a wide current density range.

Also the combined addition of 0.05 g/l of Amine No. 5, 0.0025 g/l Pluronic 10R8 and either 0.002 g/l of 2-mercaptothiazoline or 0.01 g/l Janus Green gives strongly leveling copper deposits which are bright over the whole current density range and superior to the deposits obtained in absence of one of these additives, e.g. of the polyethyer or of the Amine No. 5.

EXAMPLE IV 0.1 g/l of Amine No. 6 gives in an acid copper bath of Type 1 a copper deposit which is striated between about 0.8 and 6.0 amp./sq.dm., matte above this current density range and very thin below it. Addition of 0.015 g/l Sulfoalkylsulfide No. 1 or of 0.02 g/l of Sulfoalkylsulfide No. 7 produces a copper deposit which is bright and smooth above 0.6 amp./sq.dm. and semibright with good coverage below this current density. Final addition of 0.0015 g/l of 2-mercaptothiazoline produces strongly leveling copper deposits which are bright over the whole Hull Cell current density range (0 to more than 12 amp./sq.dm.) in either case.

If, instead of sulfoalkylsulfides No. 1 or 7, 0.08 g/l of Sulfoalkylsulfides No. 12 or 16 are added to the copper bath containing 0.1 g/l of Amine No. 6 smooth copper deposits with improved low current density coverage are obtained which are bright above about 1.5 amp./sq.dm. and show strong leveling above about 5 amp./sq.dm. on final addition of 0.0015 g/l of 2-mercaptothiazoline.

EXAMPLE V

Addition of 0.15 g/l of Amine No. 7 gives strongly striated copper deposit with smooth brightness only below about 0.5 amp./sq.dm. Further addition of 0.015 g/l of Sulfoalkylsulfide No. 1 produces a smooth copper deposit which is bright above about 0.6 amp./sq.dm. Further addition of 0.0015 2-mercaptothiazoline produces strong leveling above about 3 amp./sq.dm. and final addition of 0.0025 g/l of the polyether Pluronic F-68 (Wyandotte Chemicals Corporation), a block polymer having a polyoxypropylene group of approximate molecular weight 1750 in the center and two polyoxyethylene groups each of approximate molecular weight 3500 on either side) extends the bright current density range over the whole Hull Cell panel (0 to more than 12 amp./sq.dm.).

EXAMPLE VI 0.13 g/l of Amine No. 8, when added to an acid copper bath of Type 1, produces a uniform matte copper deposit over almost the whole Hull Cell panel. Further addition of 0.015 g/l Sulfoalkylsulfide No. 1 brightens the deposit below 4 amp./sq.dm. Final addition of 2-mercaptothiazoline produces a uniform hazy-bright copper deposit over the whole current density range except below 0.2 amp./sq.dm. where it is bright, which possesses strong leveling properties.

EXAMPLE VII 0.1 g/l of Amine No. 9, when added to an acid copper bath of Type 1, gives a copper deposit which is matter over almost the whole Hull Cell panel. Addition of 0.03 g/l of Sulfoalkylsulfide No. 1 gives a bright copper electrodeposit above 1 amp./sq.dm. and a semibright one below this current density. Final addition of 0.0015 g/l 2-mercaptothiazoline extends the bright current density range and produces moderate leveling.

EXAMPLE VIII

Amine No. 12 is so powerful that even 0.025 g/l produces a copper deposit which is bright and rough below about 2 amp./sq.dm. and strongly striated above this current density. Addition of 0.03 g/l Sulfoalkylsulfide No. 1 gives a bright deposit above about 0.9 amp./sq.dm. which is still slightly striated in the high current density range and is semibright below 0.9 amp./sq.dm. Only final addition of both 0.0015 g/l 2-mercaptothiazoline and 0.0025 g/l Pluronic F-68 gives a uniform bright and smooth copper deposit over the whole current density range with fair leveling properties.

The effectiveness of the Amines of this invention increases if one or more of the three methyl groups in Amine No. 3 is replaced by higher alkyl, sulfoalkyl, hydroxyethyl, hydroxypropyl, hydroxyalkoxy, hydroxydialkoxy groups, a second benzyl group or a phenyl group. Also the linking of 2quaternary nitrogen atoms carrying each a benzyl group by a bivalent radical gives powerful additives.

While the invention has been described and illustrated in detail, it is clearly to be understood that this is intended to be of example only and is not to be taken to be of limitation, the spirit and scope of the invention being limited only by the terms of the following claims.

What is claimed is:

1. A process for electrodepositing copper from an aqueous acidic copper plating bath containing at least one member independently selected from each of the following two groups:

A. 0.005 gram per liter to 10.0 grams per liter of quaternized aryl and aralkyl amines selected from those exhibiting the formulae:

I.

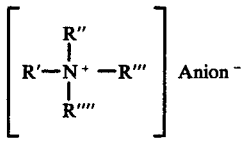

II.

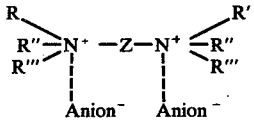

III.

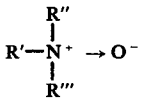

IV.

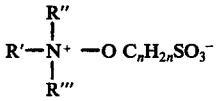

wherein R′, R″, R‴ and R⁗ are each independently selected from the group consisting of substituted and unsubstituted monovalent alkyl, aryl, aralkyl and cycloalkyl radicals provided that at least one aryl or aralkyl radical is present on each quaternary nitrogen atom; wherein Z is a bivalent hydrocarbon radical which may be substituted and/or interrupted by heteroatoms; wherein $n=3$ or 4; wherein the Anion may be absent if one of the radicals R′ to R⁗ carries an anionic substituents and B. sulfoalkyl sulfide compounds containing the grouping —S—Alk—$SO_3M$ where M is one gram-equivalent of a cation and — Alk — is a divalent radical selected from a group consisting of unsubstituted and substituted aliphatic hydrocarbon radicals containing 2 to 8 carbon atoms which may be interrupted by heteroatoms in an amount of 0.01 milligrams per liter to 1000 milligrams per liter.

2. The process as claimed in claim 1 where the cooperating amine is of the formula:

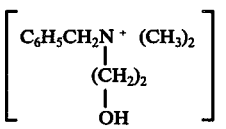

3. The process as claimed in claim 1 where the cooperating amine is of the formula:

$[C_6H_5CH_2N^+ (CH_2CHOHCH_3)_3]Cl^-$

4. The process as claimed in claim 1 where the cooperating amine is of the formula: $[(C_6H_5CH_2)_2N^+ (CH_3)_2]\ Cl^-$.

5. The process as claimed in claim 1 where the cooperating amine is of the formula:

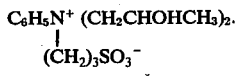

6. The process as claimed in claim 1 where the cooperating amine is of the formula:

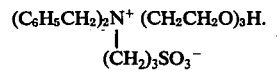

7. The process as claimed in claim 1 where the cooperating amine is of the formula:

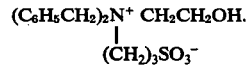

8. The process as claimed in claim 1 where the cooperating amine is of the formula:

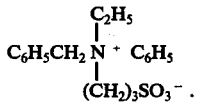

9. The process as claimed in claim 1 where the cooperating amine is of the formula:

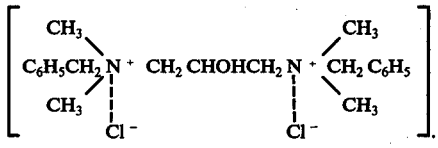

10. The process as claimed in claim 1 where the cooperating amine is of the formula:

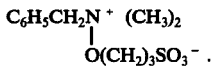

11. The process as claimed in claim 1 where the cooperating amine is of the formula:

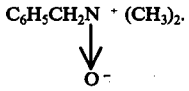

12. An aqueous acidic copper electroplating bath containing at least one member independently selected from each of the following two groups:

A. 0.005 gram per liter to 10.0 grams per liter of quaternized aryl and aralkyl amines selected from those exhibiting the formulae:

I.

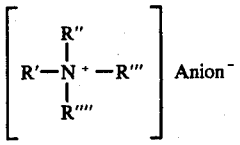

II.

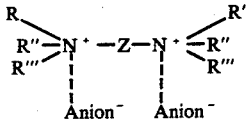

III.

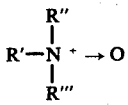

IV.

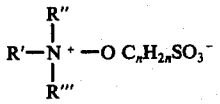

wherein R′, R″, R‴ and R⁗ are each independently selected from the group consisting of substituted and unsubstituted monovalent alkyl, aryl, aralkyl and cycloalkyl radicals provided that at least one aryl or aralkyl radical is present on each quaternary nitrogen atom; wherein Z is a bivalent hydrocarbon radical which may be substituted and/or interrupted by heteroatoms; wherein $n=3$ or 4; and wherein the Anion may be absent if one of the radicals R′ to R⁗ carries an anionic substituent and B. sulfoalkyl sulfide compounds containing the grouping —S—Alk—$SO_3M$ where M is one gram-equivalent of a cation and — Alk — is a divalent radical selected from a group consisting of unsubstituted and substituted aliphatic hydrocarbon radicals containing 2 to 8 carbon atoms which may be interrupted by heteroatoms in an amount of 0.01 milligrams per liter to 1000 milligrams per liter.

13. An aqueous acidic copper electroplating bath as claimed in claim 12 wherein the cooperating amine exhibits the formula:

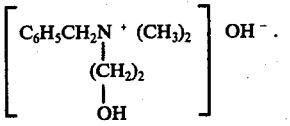

14. An aqueous acidic copper electroplating bath as claimed in claim 12 wherein the cooperating amine exhibits the formula:

$$[C_6H_5CH_2N^+(CH_2CHOHCH_3)_3]Cl^-$$

15. An aqueous acidic copper electroplating bath as claimed in claim 12 wherein the cooperating amine exhibits the formula:

$$[C_6H_5CH_2)N^+(CH_3)_2]Cl^-$$

16. An aqueous acidic copper electroplating bath as claimed in claim 12 wherein the cooperating amine exhibits the formula:

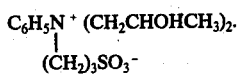

17. An aqueous acidic copper electroplating bath as claimed in claim 12 wherein the cooperating amine exhibits the formiula:

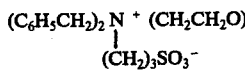

18. An aqueous acidic copper electroplating bath as claimed in claim 12 wherein the cooperating amine exhibits the formula:

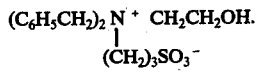

19. An aqueous acidic copper electroplating bath as claimed in claim 12 wherein the cooperating amine exhibits the formula:

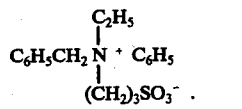

20. An aqueous acidic copper electroplating bath as claimed in claim 12 wherein the cooperating amine exhibits the formula:

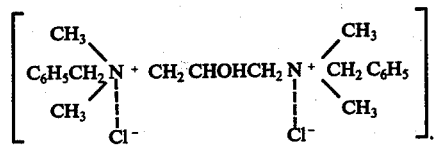

21. An aqueous acidic copper electroplating bath as claimed in claim 12 wherein the cooperating amine exhibits the formula:

22. An aqueous acidic copper electroplating bath as claimed in claim 12 wherein the cooperating amine exhibits the formula:

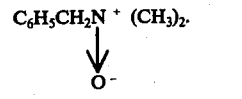

* * * * *